US009217229B2

(12) United States Patent
Ball

(10) Patent No.: US 9,217,229 B2
(45) Date of Patent: Dec. 22, 2015

(54) BARRIERS

(75) Inventor: Robert N Ball, Cheshire (GB)

(73) Assignee: ATG ACCESS LTD. (GB)

( * ) Notice: Subject to any disclaimer, the term of this patent is extended or adjusted under 35 U.S.C. 154(b) by 0 days.

(21) Appl. No.: 14/236,365

(22) PCT Filed: Jul. 20, 2012

(86) PCT No.: PCT/GB2012/051755
§ 371 (c)(1),
(2), (4) Date: Jan. 31, 2014

(87) PCT Pub. No.: WO2013/017837
PCT Pub. Date: Feb. 7, 2013

(65) Prior Publication Data

US 2014/0161523 A1 Jun. 12, 2014

(30) Foreign Application Priority Data

Aug. 1, 2011 (GB) ..... 1113203.2

(51) Int. Cl.
*E01F 13/06* (2006.01)
*E01F 13/12* (2006.01)

(52) U.S. Cl.
CPC ..... *E01F 13/06* (2013.01); *E01F 13/12* (2013.01)

(58) Field of Classification Search
CPC ..... E01F 15/00; E01F 13/06
USPC ..... 404/6; 49/9, 31, 34, 49
See application file for complete search history.

(56) References Cited

U.S. PATENT DOCUMENTS

| | | | |
|---|---|---|---|
| 1,574,908 | A | 3/1926 | Lamp |
| 1,848,516 | A | 3/1932 | Davison |
| 2,006,233 | A | 6/1935 | Chretien |

(Continued)

FOREIGN PATENT DOCUMENTS

| | | |
|---|---|---|
| CH | 700218 | 7/2010 |
| DE | 2309249 A1 | 8/1974 |

(Continued)

OTHER PUBLICATIONS

GB Combined Search and Examination Report corresponding to Application No. GB1214248.5 dated Aug. 29, 2012.

(Continued)

*Primary Examiner* — Thomas B Will
*Assistant Examiner* — Katherine Chu
(74) *Attorney, Agent, or Firm* — Niels Haun; Dann Dorfman Herrell & Skillman, PC

(57) ABSTRACT

A barrier apparatus (1) comprising a first support means (2*a*) and a separate second support means (2*b*), a flexible coupling means (20) attached to the first support means defining a through-opening (21A), a bridging member (4) supporting said flexible coupling means, wherein the bridging member is attached movably to the first support means to be movable to and from a position which places said through-opening in alignment with the second support means, and the second support means includes an obstruction part (11) adapted to extend through said through-opening when said through-opening is placed in said alignment with the second support means thereby to obstruct removal of said through-opening from said alignment with the second support means to provide a barrier comprising said flexible coupling means which extends between the first support means and the second support means.

17 Claims, 15 Drawing Sheets

(56) References Cited

U.S. PATENT DOCUMENTS

| | | | | |
|---|---|---|---|---|
| 2,263,649 | A | | 11/1941 | Sawyer |
| 3,810,595 | A | | 5/1974 | Doolittle |
| 3,861,097 | A | | 1/1975 | Patterson |
| 4,240,766 | A | * | 12/1980 | Smith et al. ..... 404/10 |
| 4,571,118 | A | * | 2/1986 | Schmanski ..... 404/10 |
| 4,576,508 | A | | 3/1986 | Dickinson |
| 4,844,653 | A | | 7/1989 | Dickinson |
| 4,919,563 | A | | 4/1990 | Stice |
| 4,973,189 | A | | 11/1990 | Bechtold |
| 4,989,835 | A | * | 2/1991 | Hirsh ..... 256/13.1 |
| 5,474,017 | A | | 12/1995 | Mohebbi |
| 5,481,828 | A | | 1/1996 | Kentrotas |
| 5,547,310 | A | | 8/1996 | Muller |
| 5,740,629 | A | * | 4/1998 | Fischer et al. ..... 49/9 |
| 5,829,912 | A | | 11/1998 | Marcotullio |
| 5,975,792 | A | | 11/1999 | Goeken |
| 6,174,103 | B1 | | 1/2001 | Stroman |
| 6,435,760 | B1 | | 8/2002 | Pettesch |
| 6,626,606 | B1 | | 9/2003 | Johnson |
| 7,244,075 | B2 | | 7/2007 | Stadler |
| 7,607,856 | B2 | | 10/2009 | Patel |
| 7,850,391 | B2 | | 12/2010 | Omar |
| 8,096,727 | B2 | | 1/2012 | Parenti |
| 8,197,156 | B2 | | 6/2012 | Morgan |
| 8,215,865 | B2 | | 7/2012 | Adler |
| 8,277,143 | B2 | | 10/2012 | Adler |
| 8,523,479 | B2 | | 9/2013 | Adler |
| 2003/0051406 | A1 | | 3/2003 | Ritz |
| 2003/0145498 | A1 | | 8/2003 | Venegas |
| 2004/0091315 | A1 | | 5/2004 | Yodock |
| 2004/0151542 | A1 | | 8/2004 | Johnson |
| 2004/0159055 | A1 | | 8/2004 | Stone |
| 2005/0031411 | A1 | | 2/2005 | Hensley |
| 2005/0073275 | A1 | | 4/2005 | Robb |
| 2005/0098770 | A1 | | 5/2005 | Schell |
| 2006/0204327 | A1 | | 9/2006 | Phelan |
| 2006/0233608 | A1 | | 10/2006 | Netah |
| 2007/0031189 | A1 | | 2/2007 | Stadler |
| 2007/0086858 | A1 | | 4/2007 | Morgan |
| 2007/0258762 | A1 | | 11/2007 | Stice |
| 2008/0038056 | A1 | | 2/2008 | Patel |
| 2008/0038057 | A1 | | 2/2008 | Stadler |
| 2008/0112756 | A1 | | 5/2008 | Omar |
| 2008/0187396 | A1 | | 8/2008 | McCue |
| 2009/0047066 | A1 | | 2/2009 | Stice |
| 2009/0202296 | A1 | | 8/2009 | Lamore |
| 2009/0208285 | A1 | | 8/2009 | Adler |
| 2009/0250674 | A1 | | 10/2009 | Darcy |
| 2010/0166498 | A1 | | 7/2010 | Adler |
| 2010/0290832 | A1 | | 11/2010 | House |
| 2011/0033232 | A1 | | 2/2011 | Adler |
| 2012/0230764 | A1 | | 9/2012 | Lafont |
| 2012/0251236 | A1 | | 10/2012 | Hild |
| 2012/0308302 | A1 | | 12/2012 | Adler |
| 2013/0034387 | A1 | | 2/2013 | Adler |
| 2014/0003867 | A1 | | 1/2014 | Ball |
| 2014/0010591 | A1 | | 1/2014 | Ball |
| 2014/0017003 | A1 | | 1/2014 | Ball |
| 2014/0119825 | A1 | | 5/2014 | Castro |
| 2014/0147201 | A1 | | 5/2014 | Ball |
| 2014/0161521 | A1 | | 6/2014 | Ball |
| 2014/0161523 | A1 | | 6/2014 | Ball |

FOREIGN PATENT DOCUMENTS

| | | | |
|---|---|---|---|
| DE | 3605747 | | 8/1987 |
| DE | 9316170 | | 3/1994 |
| DE | 9315671 | | 6/1994 |
| DE | 19631678 | | 2/1998 |
| DE | 19812116 | | 9/1999 |
| DE | 19815426 | | 10/1999 |
| DE | 202005013439 | U1 | 8/2005 |
| DE | 102007052321 | A1 | 5/2009 |
| EP | 0176973 | A2 | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2598484 | | 11/1987 |
| FR | 2621625 | | 4/1989 |
| FR | 2680190 | | 7/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 2775992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2012 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | | 2/1987 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | A | 5/2009 |
| WO | 9709485 | | 3/1997 |
| WO | 2004048702 | | 6/2004 |
| WO | 2004099534 | | 11/2004 |
| WO | 2007001326 | A2 | 1/2007 |
| WO | 2007008813 | | 1/2007 |
| WO | 2007018531 | A1 | 2/2007 |
| WO | 2007191977 | | 8/2007 |
| WO | 2007103394 | | 9/2007 |
| WO | 2009112159 | | 9/2009 |
| WO | 2010132616 | A1 | 11/2010 |
| WO | WO2013017837 | | 2/2013 |

OTHER PUBLICATIONS

GB Combined Search and Examination Report corresponding to GB1214278.2 dated Dec. 10, 2012.

GB Search Report corresponding to Application No. GB1101514.6 dated May 27, 2011.

GB Search Report corresponding to GB1104802.2 dated May 25, 2012.

GB Search Report corresponding to GB1113211.5 dated Jan. 17, 2012.

International Search Report corresponding to PCT/GB2012/050173 dated May 22, 2012.

International Search Report corresponding to PCT/GB2012/050175 dated May 23, 2012.

International Search Report corresponding to PCT/GB2012/050176 dated May 21, 2012.

Search Report corresponding to Application No. GB1101513.8 dated May 26, 2011.

Written Opinion of the International Search Authority corresponding to PCT/GB2012/050173 dated May 22, 2012.

Written Opinion of the International Search Authority corresponding to PCT/GB2012/050175 dated May 23, 2012.

Written Opinion of the International Search Authority corresponding to PCT/GB2012/050176 dated May 21, 2012.

(56) References Cited

OTHER PUBLICATIONS

GB Combined Search and Examination Report corresponding to GB1214276.6 dated Mar. 19, 2013.
GB Examination Report corresponding to GB 1214276.6 dated Jul. 22, 2013.
GB Search Report corresponding to GB 1113203.2 dated Jan. 25, 2012.
GB Search Report corresponding to GB1109010.7 dated Sep. 16, 2011.
GB Search Report corresponding to GB1214276.6 dated Nov. 17, 2012.
International Search Report corresponding to PCT/GB2012/051198 dated Aug. 30, 2012.
Written Opinion of the International Searching Authority corresponding to PCT/GB2012/051198 dated Aug. 30, 2012.
International Search Report corresponding to Application No. PCT/GB2012/051755 dated Mar. 12, 2013.
Written Opinion of the International Searching Authority corresponding to PCT/GB2012/051755 dated Mar. 12, 2013.
Search Report with abstracts and figures Aug. 18, 2010.
Search Report with abstracts and figures Aug. 19, 2010.
Search Report with abstracts and figures Aug. 19, 2010-bis.
Search Report with abstracts and figures Aug. 20, 2010.
Search Report with abstracts and figures Oct. 2, 2010.
Search Report with abstracts and figures Mar. 23, 2015.

* cited by examiner

BARRIERS

RELATED APPLICATIONS

This application is a 371 application of International Application No. PCT/GB2012/051755 filed Jul. 20, 2012, which claims the benefit of priority of United Kingdom Patent Application No. 1113203.2 filed Aug. 1, 2011. Each of the foregoing applications is hereby incorporated herein by reference.

This invention relates to barriers, and particularly though not exclusively, to impact barriers such as vehicle impact barriers.

Rapidly deployable barriers exist typically in a form comprising light-weight posts between which light-weight ropes, beams or other barrier elements extend. However, the light-weight property of such barriers often means that they are not robust and are wholly unsuitable for use in resisting significant transverse forces, such as vehicular impact forces.

Conversely, vehicle impact barriers are typically not only very heavy but also permanent, or semi-permanent in form, and cannot be rapidly deployed and subsequently removed.

The invention aims to provide a barrier, such as a vehicle impact barrier, which may address these deficiencies.

In a first of its aspects the invention may provide a barrier apparatus comprising: a first support means and a separate second support means; a flexible coupling means attached to the first support means defining a through-opening; a bridging member supporting said flexible coupling means, wherein the bridging member is attached movably to the first support means to be movable to and from a position which places said through-opening in alignment with the second support means; and the second support means includes an obstruction part adapted to extend through said through-opening when said through-opening is placed in said alignment with the second support means thereby to obstruct removal of said through-opening from said alignment with the second support means to provide a barrier comprising said flexible coupling means which extends between the first support means and the second support means. The obstruction part may be static or fixed, or may be adapted to move to removably extend through said through-opening when said through-opening is placed in said alignment. The obstruction part may be fixed to the second support means, and the bridging member may be adapted to removably place the through-opening around the obstruction part when the through-opening is placed in said alignment. The obstruction part is preferably substantially rigid. It is preferably firmly (optionally movably) attached to the body of the second support means. In this way the obstruction means may preferably be movable relative to the body of the second support means preferably only in the directions of retraction and extension thereof to/from the body of the second support means.

The obstruction part may be arranged to retractably extend from the second support means through said through-opening from said second support means. The obstruction part may be arranged to retractably extend from the second support means, being retractable partly or wholly into the body of the second support means. The second support means may be arranged to sheath the obstruction part partly or wholly when in the retracted state. The second support means may be at least partly hollow to accommodate the obstruction part when retracted. For example, the obstruction part may be arranged to retractably extend by a linear movement (e.g. a vertical movement). The obstruction part may be elongated, and may be substantially linear (e.g. a shaft).

Desirably, the flexible coupling means defines a further through-opening through which said first support means extends.

Preferably, the flexible coupling means comprises a flexible coupling line.

The through-opening may be a loop defined by the flexible coupling means. The further through-opening may be a loop defined by the flexible coupling means.

The flexible coupling means may comprise any one or more of rope, cable, wire or chain.

The through-opening and the further through-opening may comprise separate loops joined by a splice within the flexible coupling means.

One or both of the first and second support means may comprise a stanchion.

The obstruction part may comprise a transverse flange means projecting therefrom in a direction transverse to the direction in which the obstruction part is arranged to extend through the through-opening and positionable to locate the through-opening between the transverse flange means and other parts of the second support means.

The bridging member may include a malleable conduit member extending through said through-opening and through which said obstruction part is adapted to removably extend when said through-opening is in said alignment accordingly to locate the conduit member between the transverse flange means and other parts of the second support means.

The malleable conduit member may comprise a stop flange projecting outwardly of the conduit member in a direction transverse to the axis of the conduit and adapted to be movable to abut the transverse flange means in response to motive force applied thereto by parts of the flexible coupling means defining the through-opening.

The first support means may comprise a further stop flange projecting outwardly therefrom over parts of the coupling means defining the further through-opening thereby to obstruct movement of the through-opening therebeyond.

The first support means may comprise a shaft part and a sleeve part mounted upon the shaft part to revolve about the axis thereof wherein which said bridging member is attached to the sleeve part to swing to and from said position of alignment by action of said revolving.

The sleeve part may be elongate. The shaft part may define an elongate axis sheathed by said sleeve part wherein the orientation of the sleeve part relative to the shaft part is adjustable to adjust the inclination thereof relative to the elongate axis of the shaft part thereby to adjust the inclination of the bridging member to raise or lower the through-opening to adjust said alignment.

The sleeve part may be revolvable via a universal pivot means via which it is mounted to the shaft part.

Preferably the bridging means is substantially frangible.

The bridging means may be arranged to be variable in length telescopically.

The barrier apparatus may define a gate.

In a second of its aspects, the invention may provide a vehicle impact barrier apparatus comprising the barrier apparatus according to the invention in its first aspect.

The flexible coupling means is preferably adapted to absorb vehicular impact energy by flexure or by stretching in response thereto.

It is envisaged that the invention may be sold or shipped in disassembled form and so the invention may provide a kit of parts for assembly into a barrier apparatus, a gate or a vehicle impact barrier.

The barrier may comprise a plurality of such pairs of support means (e.g. posts, stanchions etc) coupled in this way. The barrier may comprise a second said flexible coupling means (with two said though-openings) and a third support means coupled to one of the first and second support means via the second flexible coupling line as described above. Preferably each support means is coupled to only one or two neighbouring support means (e.g. posts, stanchions) via a respective one flexible coupling means. Thus a given support means may bear two flexible support means (loops) if it has two separate neighbours. This provides a barrier comprising a plurality of flexible coupling means each of which separately extends between two successive support means in the barrier.

The obstruction part may be static or fixed, or may be adapted to move to removably extend through a respective through-opening.

The through-openings may be loops defined by the flexible coupling means. The flexible coupling means may comprise any one or more of rope, cable, wire or chain. The through-openings may comprise separate loops joined by a splice within the flexible coupling means.

One or both of the first and second support means may comprise a stanchion.

An obstruction part may comprise a transverse flange means projecting therefrom in a direction transverse to the direction in which the obstruction part is arranged to extend through the respective through-opening of a coupling means such that the through-opening is positioned between the transverse flange means and other parts of the associated support means.

The bridging member may include a malleable conduit member extending through the through-opening and through which the obstruction part extends to locate the conduit member between the transverse flange means and other parts of the associated support means.

The malleable conduit member may comprise a stop flange projecting outwardly of the conduit member in a direction transverse to the axis of the conduit and adapted to be movable to abut the transverse flange means in response to motive force applied thereto by parts of the flexible coupling means defining the through-opening.

Preferably, the flexible coupling means supported by the bridging member is not tensioned within the bridging member, or between the two support means it couples. Its weight is preferably supported by the bridging member. This ability to avoid tension in the quiescent coupling means enhances the longevity of the tensile, or impact-resistive properties of the coupling means e.g. when a rope. It avoids "creep" which often occurs in pre-tensioned barrier ropes.

The flexible coupling means according to any aspect of the invention may be a nylon rope. It may be a plait rope. It may have a braided construction. The through-openings may be loops spliced into the plaid rope as part of the plait structure. A standard "tuck splice" (e.g. 4-3-2- or 5-4-3-Tuck splice), or a "lockstitch" type splice may be employed to this end. The rope may have an elongation at break of between 3% and 40%, more preferably between 25% and 40% (e.g. 30%-35%), or a lower value range of 3% to 7% (e.g. 4%-5%), as required. Maximum tensile strengths of up to 2000 kM may preferably be provided with such a rope.

Non-limiting examples of the invention will now be described by way of exemplary embodiments with reference to the accompanying drawings of which:

Figure 12:
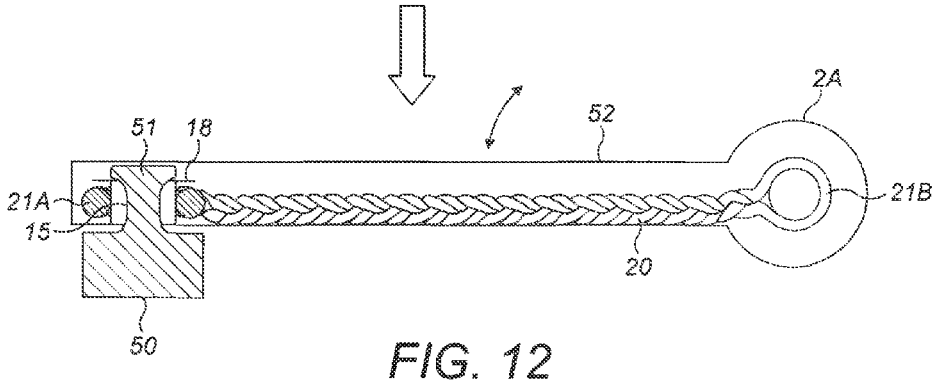
Figure 13:
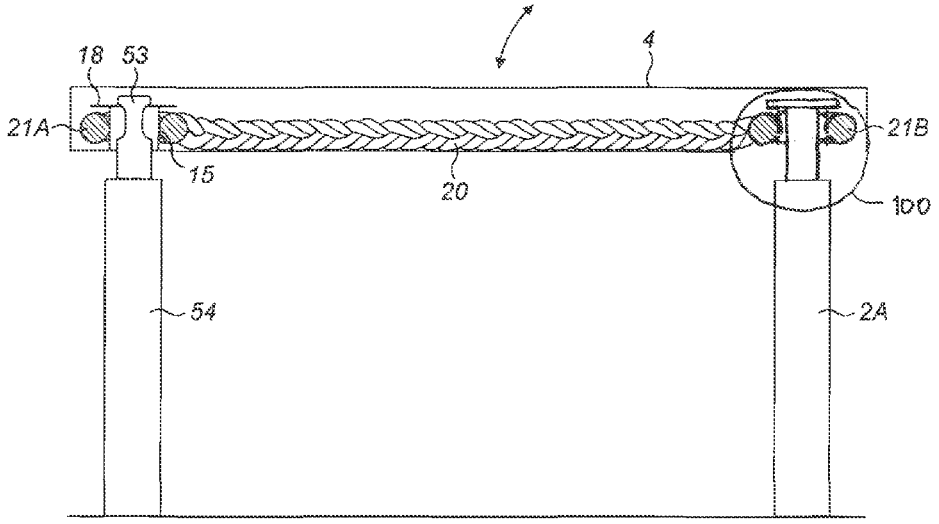
Figure 14:
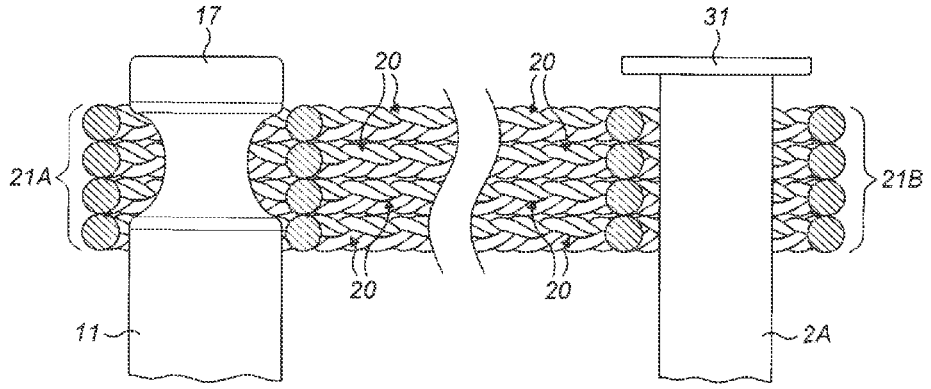
Figure 15:
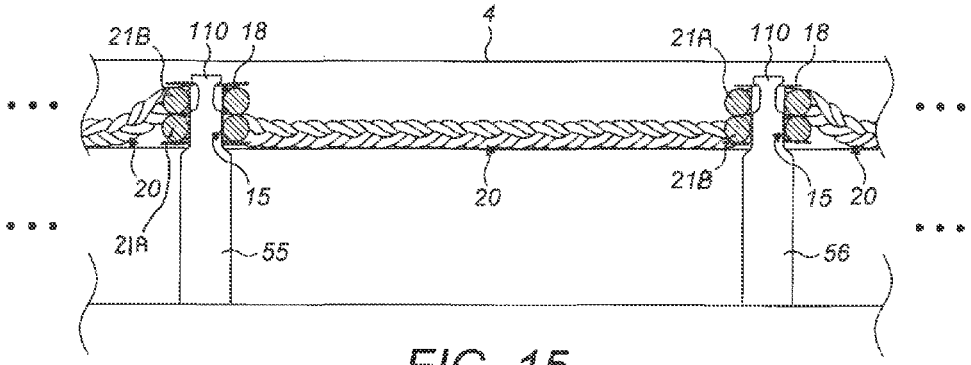
Figure 16A:
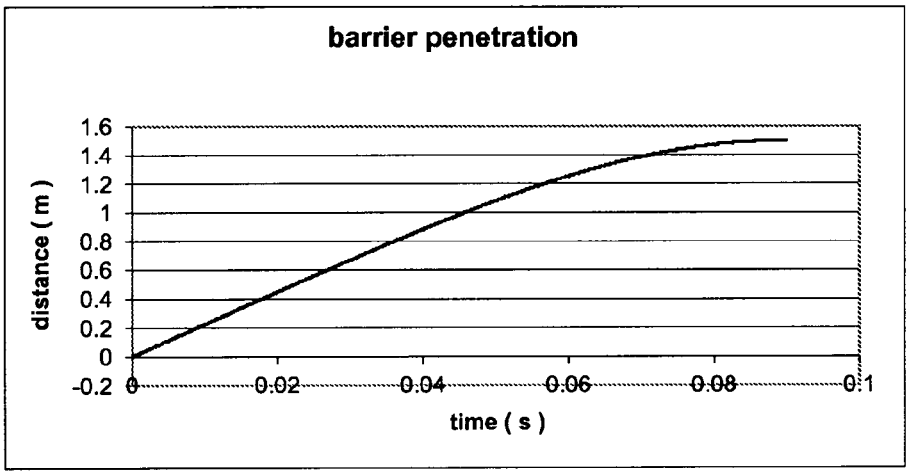
Figure 16B:
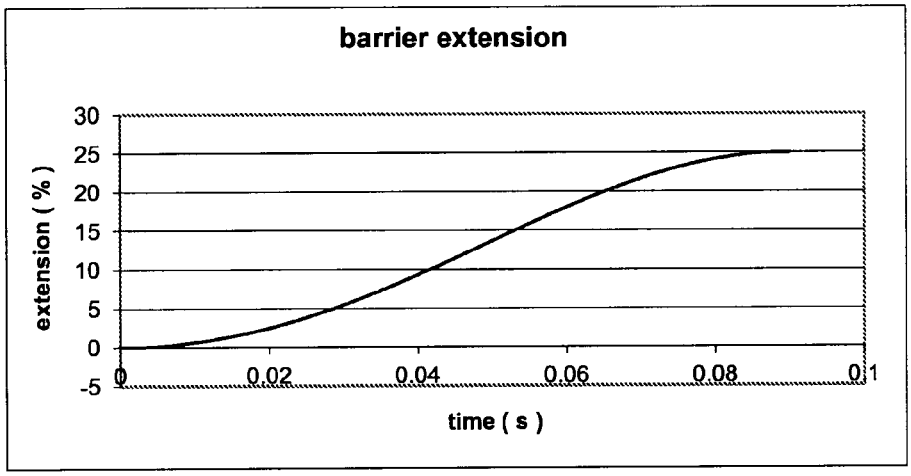
Figure 16C:
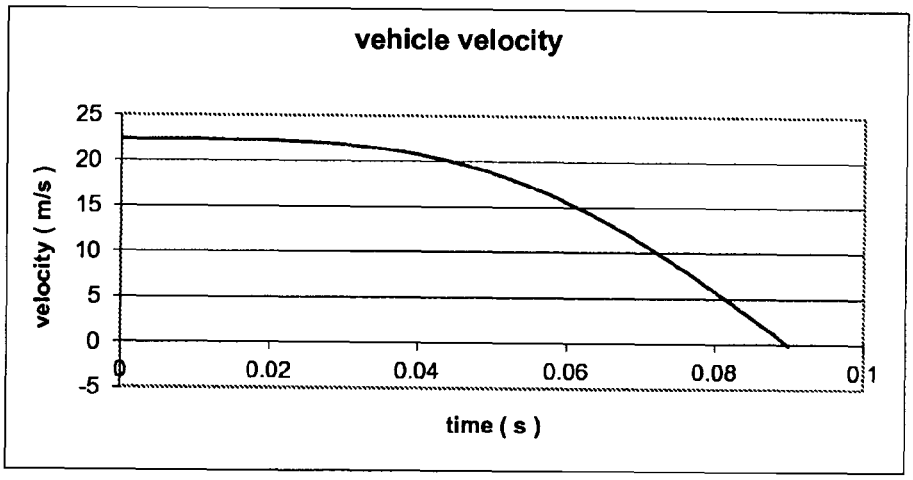
Figure 16D:
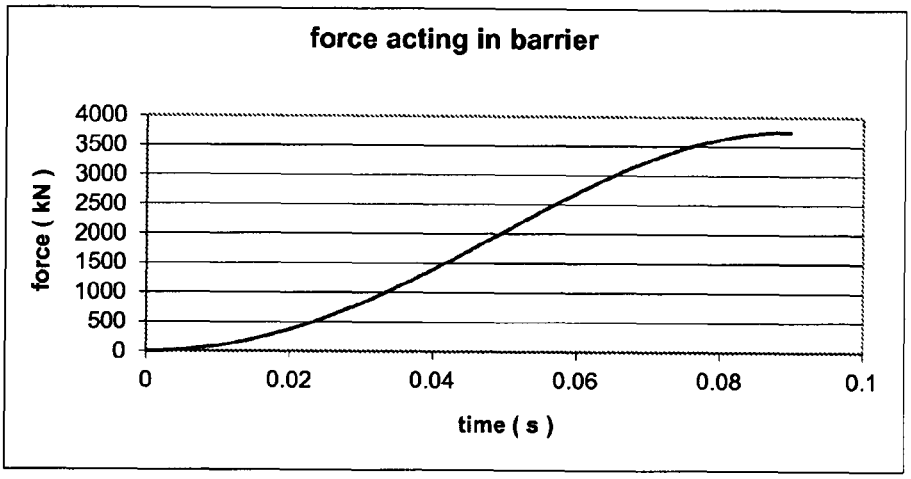

FIG. 12 schematically illustrates an alternative embodiment employing a fixed horizontal obstruction shaft and horizontal conduit within the distal end of the bridging arm for receiving the shaft;

FIG. 13 schematically illustrates an alternative embodiment employing a fixed vertical obstruction shaft and vertical conduit within the distal end of the bridging arm for receiving the shaft, the bridging arm pivotingly coupled to a stanchion to swing in the vertical plane to open and close the gate;

FIG. 14 schematically shows how a group of separate loop-ended ropes may be employed to couple the stanchions of the gate or of the fence of FIG. 15;

FIG. 15 schematically illustrates a fence.

FIGS. 16A-16D illustrate the computed values of: barrier penetration, barrier extension, vehicle velocity, and force acting on a barrier, respectively.

In the drawings, like items are assigned like reference numerals.

Figure 1:
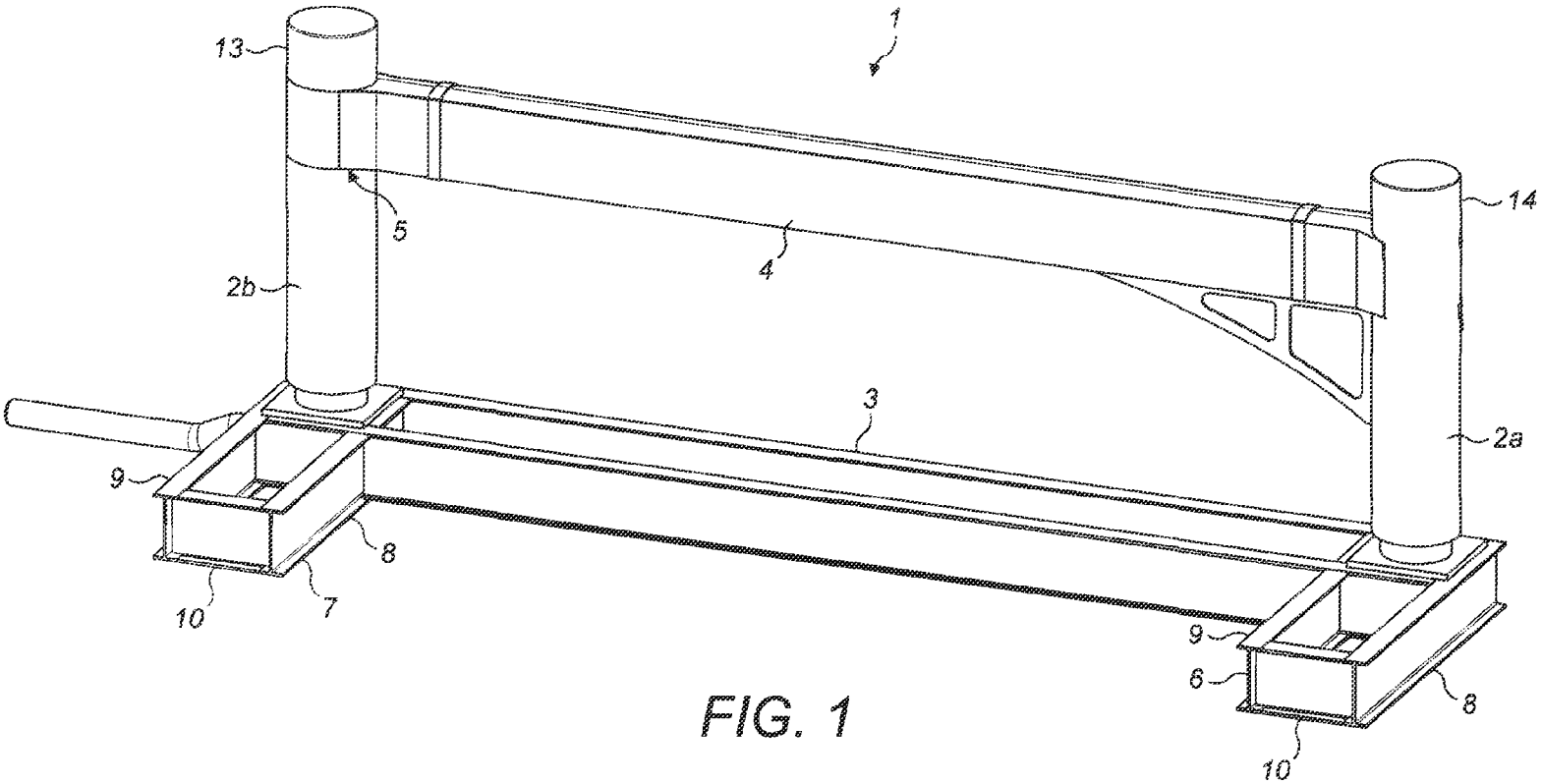
FIG. 1 illustrates a barrier in the closed state.

Referring to FIG. 1, a vehicle impact barrier is illustrated in the form of a gate (1) comprising a first substantially vertical stanchion (2*a*) and a separate second substantially vertical stanchion (2*b*) rigidly joined to the first stanchion by a pair of parallel base beams (3) which separate the two stanchions.

Figure 2:
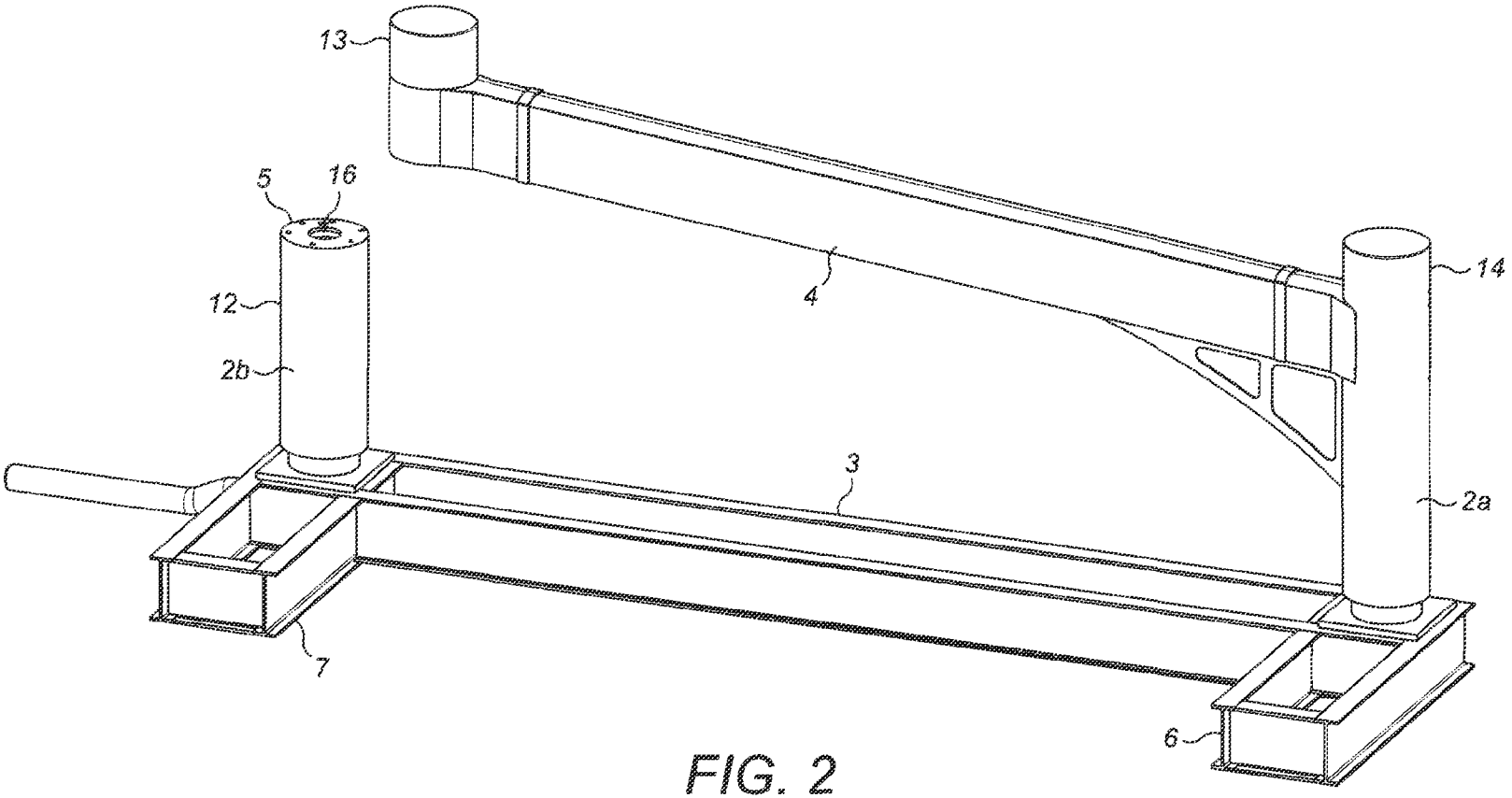
FIG. 2 illustrates the barrier of FIG. 1 in the partially open state.

The gate includes a bridging arm (4) a proximal end of which is attached revolvably to the first stanchion at its head end uppermost in use. The bridging arm is adapted so as to revolve about the head end of the first stanchion to allow it to move between a closed position (as shown in FIG. 1) in which a distal end of the bridging arm is aligned in register over the head end (5) of the second stanchion, and an open position (e.g. as shown in FIG. 2) in which no such alignment occurs.

Accordingly, the bridging arm is revolvable from a position in which it extends from the first stanchion to the second, and to another position in which it does not. Another such position may be one in which the bridging arm extends in a direction generally transverse (e.g. perpendicular) to the longitudinal axis of the pair of parallel base beams (3) extending between the first and second stanchions. This represents the fully open state of the gate (not shown).

Fixed to and extending from the base beam pair, in a direction substantially perpendicular to the longitudinal axis of the beam pair, the first stanchion and the second stanchion, are a first foot assembly (6) adjacent to the first stanchion, and a separate second foot assembly (7) adjacent to the second stanchion.

Each foot assembly comprises a pair of parallel beams (8, 9) fixed, by welding, at a respective proximal end, to the base beam pair and, at a respective distal end, to the corresponding end of the other beam of the foot assembly via a cross-beam piece (10) welded to both beams of the foot to join them at their distal ends.

Each foot assembly serves to assist in resisting the toppling or pushing-over of the barrier assembly in the direction of the foot assemblies, when the gate is closed, locked and subject to vehicular impact at the side of the barrier opposite to the side from which the foot assemblies extend.

The base beam pair, and the foot assemblies, are foundation parts of the barrier and may preferably be buried, in use, in a ground excavation with the stanchions upstanding from the ground. They may be buried in cement, or the like, in use.

The second stanchion includes a locking assembly which includes a retractably extendible obstruction shaft (11) adapted to be housed by the hollow body (12) of the second stanchion.

Figure 3:
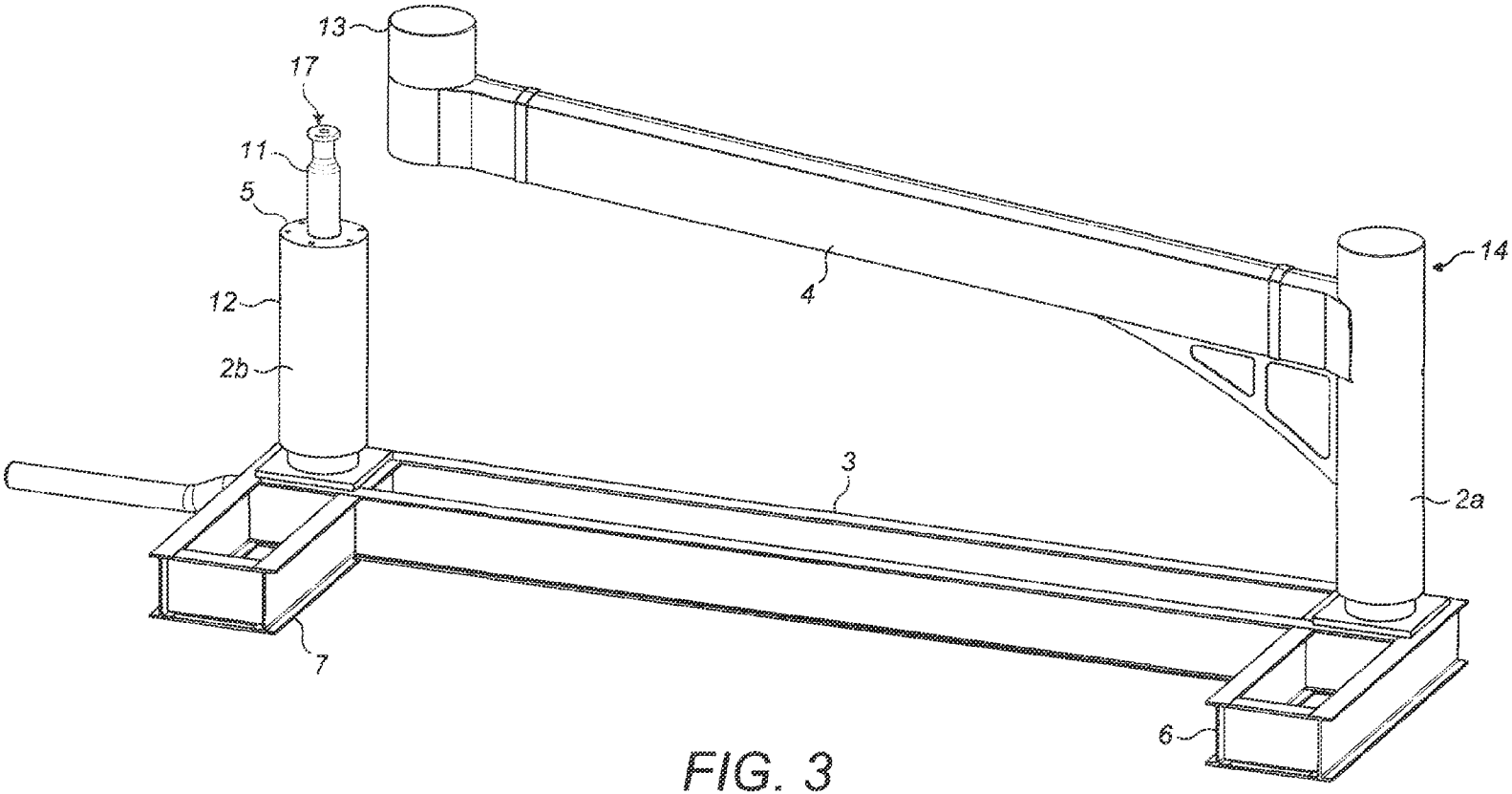
FIG. 3 illustrates the barrier of FIG. 2 with an obstruction shaft extended.

Referring to FIGS. 2 and 3 the gate in shown in a partially open state (FIG. 2) reviewing the head end (5) of the second stanchion (2B). An opening (16) is formed in the head end of the second stanchion through which a locking assembly (in the form of a steel pin (11)), is retractably extendable to pass through the opening (16) and project upwardly from the head end of the second stanchion. FIG. 2 shows the retractably extendable obstruction shaft (11) in the retracted state, while FIG. 3 shows the obstruction shaft (11) in the extended state.

Figure 4:
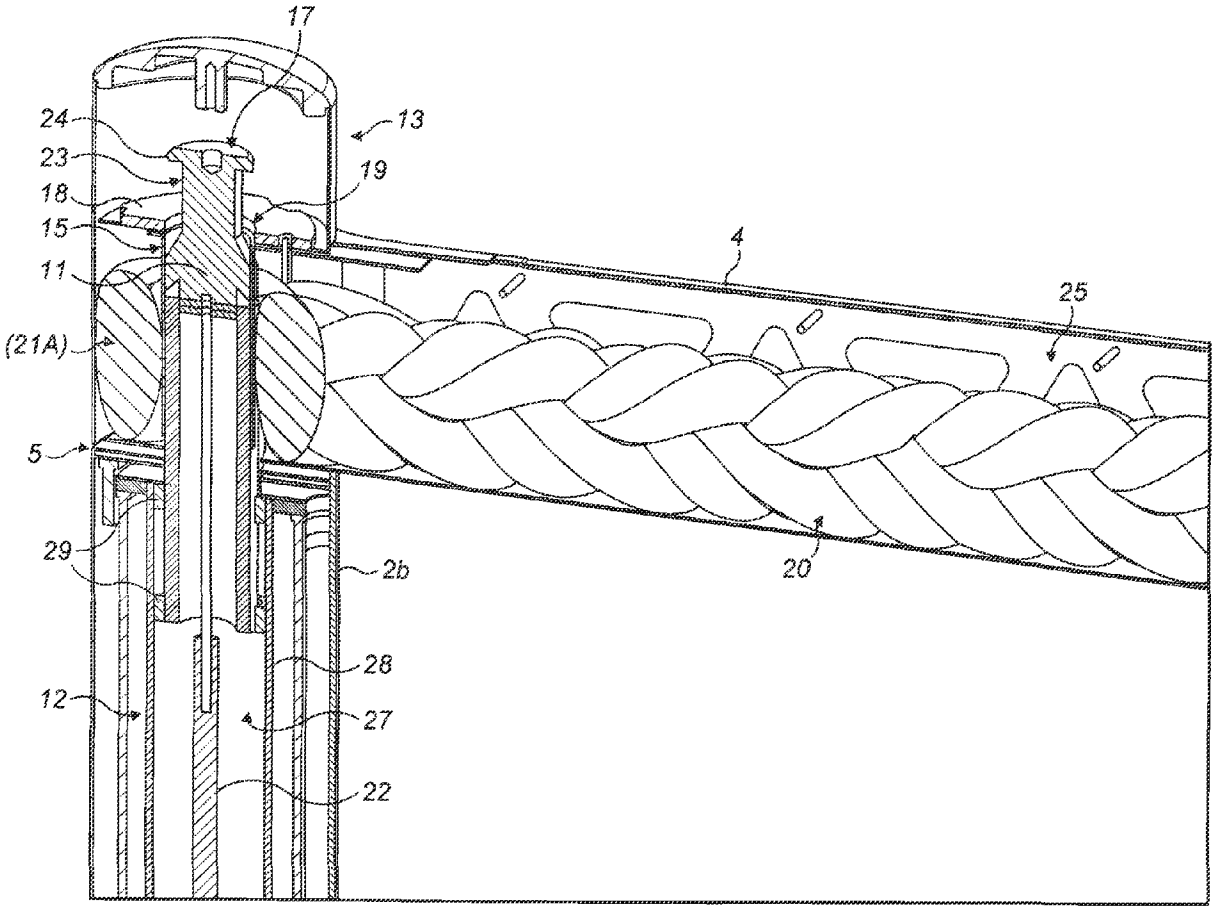
FIG. 4 shows in cross-section parts of the barrier of FIG. 1 in the closed and locked state with the obstruction shaft extending through a loop in an end of a plait rope supported by a bridging arm.

FIG. 4 provides a cross-sectional view of a part of the gate (1) including the second stanchion, and the distal end of the bridging arm (4) positioned in register with the head end (5) of the second stanchion.

The distal end (13) of the bridging arm includes a conduit (15) through which the obstruction shaft is dimensioned and adapted to fully extend when in the extended state. The diameter of the bore of the conduit closely matches the maximum outer diameter of the obstruction shaft such that the obstruction shaft can pass easily through and along the bore. The obstruction shaft is arranged to extend from the head end (5) of the second stanchion by an amount exceeding the length of the conduit (15) at the head end of the bridging arm such that, when the conduit is placed, by the bridging arm, in register with the opening (16) at the head end of the second stanchion, the obstruction shaft is able to be extended through and along the bore of the conduit as it is moved to the extended state as shown in FIGS. 3 and 4. When fully extended, the head end (17) of the obstruction shaft projects beyond the conduit.

An aluminium, (or other suitably deformable or ductile metal,) collar member (18) is fitted to the distal end of the bridging arm at and around the exit of the conduit uppermost in use. It possesses an opening (19) dimensioned to permit the obstruction shaft to pass through.

A nylon braided (or plait) rope (20) is housed within and supported by the bridging arm and passes from the first stanchion (2A) to the second stanchion (2B). The weight of the rope is supported by the bridging arm. The rope is not pretensioned. A loop (21A,21B) is formed at each end of the rope. The conduit (15) at the distal end of the bridging arm is arranged to pass through the loop (21A) of the rope at the distal end. Consequently, a swinging movement of the bridging arm (4) between the closed and open states (e.g. as partially shown in FIGS. 2 and 3) enables the bridging arm to move its distal end into register with the head end (5) of the second stanchion as shown in FIG. 4 and thereby bring the conduit (15) at the distal end into register with the through-opening (5) at the head end of the second stanchion to permit the obstruction shaft to pass through the conduit, and to thereby concurrently pass through the loop (21A) in the nylon rope at the distal end. This is shown in FIG. 4 in which the rope is illustrated, and the distal loop is shown in cross-section for clarity.

A pneumatic, hydraulic or electro/mechanical ram or actuator (22) is employed for the purposes of retractably extending the obstruction shaft to and from the head end of the second stanchion.

The diameter of the obstruction shaft narrows towards the head end of the obstruction shaft to form a construction or waist (23) immediately prior to a flare, flange or lip (24) radially projecting circumferentially from the obstruction shaft thereby forming a recess which extends around the circumference of the shaft prior to its head end (17).

The bridging arm (4) is formed from a material sufficiently robust to support the braided nylon rope, yet sufficiently weak or frangible to break when impacted by a vehicle. Thin metal or a plastic material may be suitable for these purposes. The bridging arm, between its distal end (13) and its proximal end (14) adjacent the first stanchion, comprises a generally box-section linear hollow conduit (25) comprised of two telescopically coupled portions (26A,26B) which are able to be axially slid, one relative to the other, to telescopically extend or reduce the length of the arm as required. This permits adjustment of the width of the gate should the first or second stanchion be moved relative to the other stanchion.

The breakability of the bridging arm is provided such that when a vehicle impacts the bridging arm its structure will yield quickly to the impact forces without substantially damaging the braided nylon rope within it and without causing a substantial obstruction to the nylon rope engaging with the body and structure of the impacting vehicle.

Once the nylon rope has engaged with the impacting vehicle, its material and structure is such as to yield or stretch in order to absorb impact forces, without fracturing or breaking, thereby to allow the absorbed impact forces to be transferred to the first and second stanchions.

Under such an impact, forces and energy are transferred from the rope via its looped ends (21A,21B) to the first and second stanchions. In particular, such impact forces will generally be in the form of a force transverse to the longitudinal axis of a given stanchion and the longitudinal axis of the obstruction shaft in the second stanchion.

Figure 5:
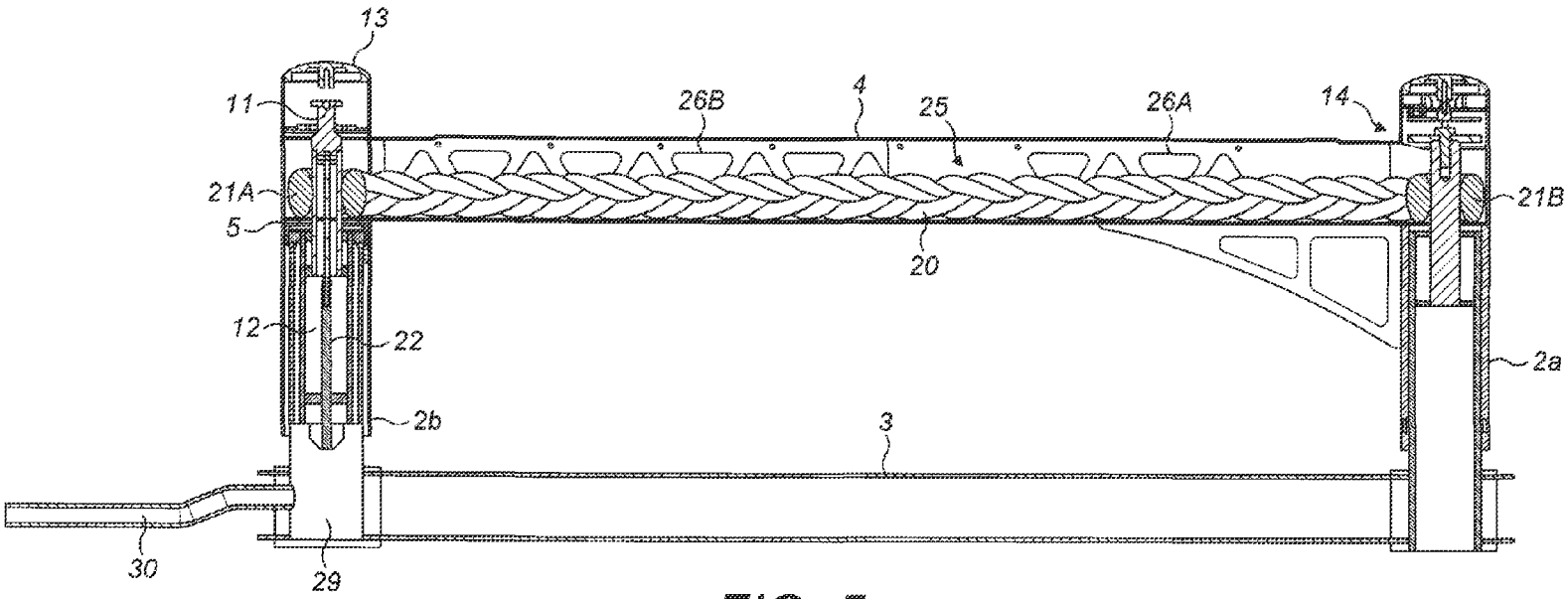
FIG. 5 illustrates in cross-section the barrier of FIG. 1 and FIG. 4.
Figure 6:
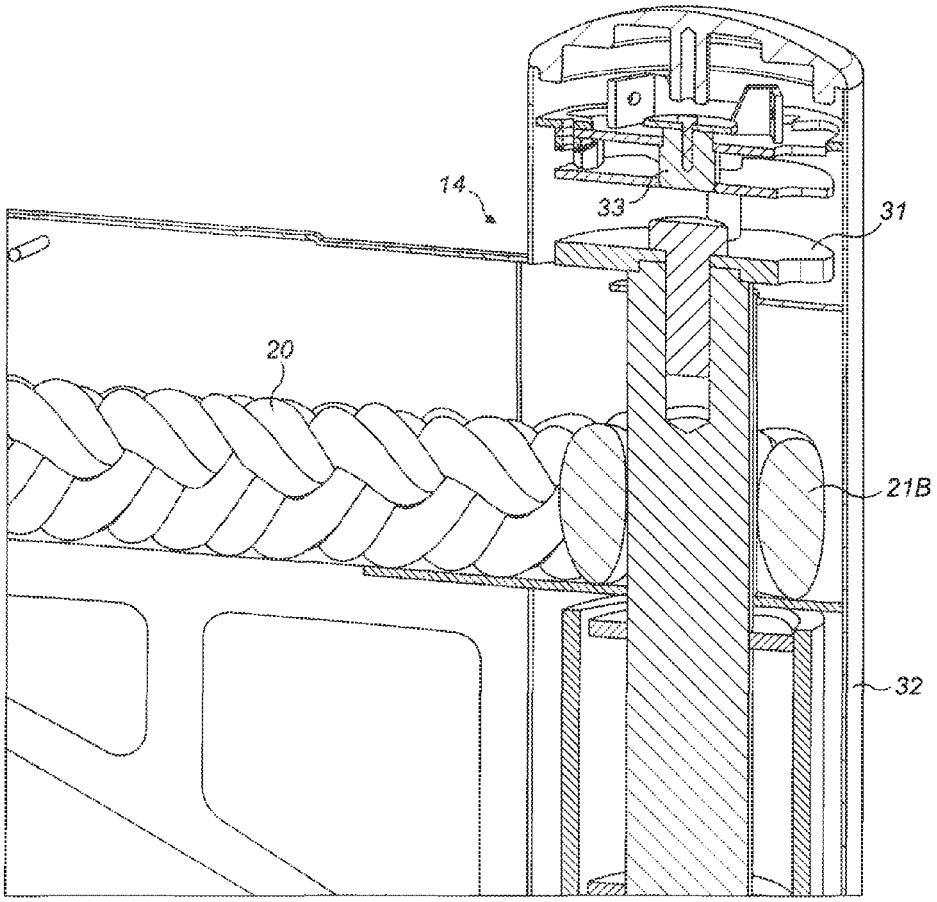
FIG. 6 shows in cross-section parts of the barrier of FIGS. 1, 4 and 5 in the closed state with a shaft of a stanchion passing through a loop in an end of a plait rope supported by a bridging arm.

It is to be noted that the loop (21B) in the rope at the proximal end thereof, (i.e. the proximal loop) is placed around a substantially fixed and rigid shaft passing along the longitudinal access of the first stanchion, as shown in FIGS. 5 and 6. Conversely, the distal loop (21A) is arranged to loop around the retractably extendable obstruction shaft when in the extended state as shown in FIG. 4. The obstruction shaft is adapted to be slidably movable along the inner bore (27) of a guide tube (28) located within the hollow body (12) of the second stanchion. The base region of the obstruction shaft has mounted upon it a pair of spaced bearing rings (29) which form a sliding interface between the body of the obstruction shaft and the bore of the guide tube. When the obstruction shaft is in the fully extended state, this lower portion of the obstruction shaft is immediately adjacent to the uppermost end of the guide bore. When the obstruction shaft is subject to transverse vehicular impact forces, it is this interface between the lower portions of the obstruction shaft and the upper portions of the guide bore which serve to retain the obstruction shaft in a substantially vertical state as a result of reactive forces which resist the torque generated by the transverse vehicular forces upon the obstruction shaft.

Should the obstruction shaft be slightly inclined as a result of the torque applied in this way, or should the vehicular impact forces include a vertical component, then the distal loop (21A) of the rope may be inclined to move along the obstruction shaft towards its head end (17). In doing so, the distal loop may be caused to impact upon the deformable collar member (18) located at the head end of the conduit at the distal end of the bridging arm. In doing so, the impacting distal loop tends to force the conduit, and the collar member at its top, towards and into the recessed waist portion (23) of the obstruction shaft. The structure of the conduit is also arranged and designed to yield under typical forces which are expected to be applied by the distal loop of the rope in these circumstances such that the deformable collar member is pushed into the waist region of the obstruction shaft so as to impinge against the underside of the flange or lip (24) at the head end of the obstruction shaft. Consequently, the deformable collar member is thereby trapped between the head end of the obstruction shaft and the upwardly urging distal loop of the rope. The deformability of the deformable collar member assists in causing the collar to be gouged into and to wrap around the lip at the head end of the obstruction shaft. This greatly assists in providing a substantial obstruction to the removal of the distal loop from the obstruction shaft when vehicular impact forces cause the distal loop to move upwardly along the obstruction shaft. It greatly assists in keeping the braided rope in position and attached to the second stanchion thereby continuing to function as a barrier.

FIG. 5 illustrates the gate in the closed state in cross-section showing both the proximal and the distal loops of the braided rope in position around respective shafts in the first and second stanchions. The two separate but telescopically joined portions (26A,26B) of the bridging arm are also visible. Means for powering the ram or actuator serving the retractably extendable obstruction shaft are housed in the base (29) of the second stanchion and are served by power and/or pneumatic/hydraulic cables which pass along a service conduit (30) leading to the base of the second stanchion. A hydraulic pump an electrical motor or a pneumatic pump or drive may be used for this purpose.

Figure 7:
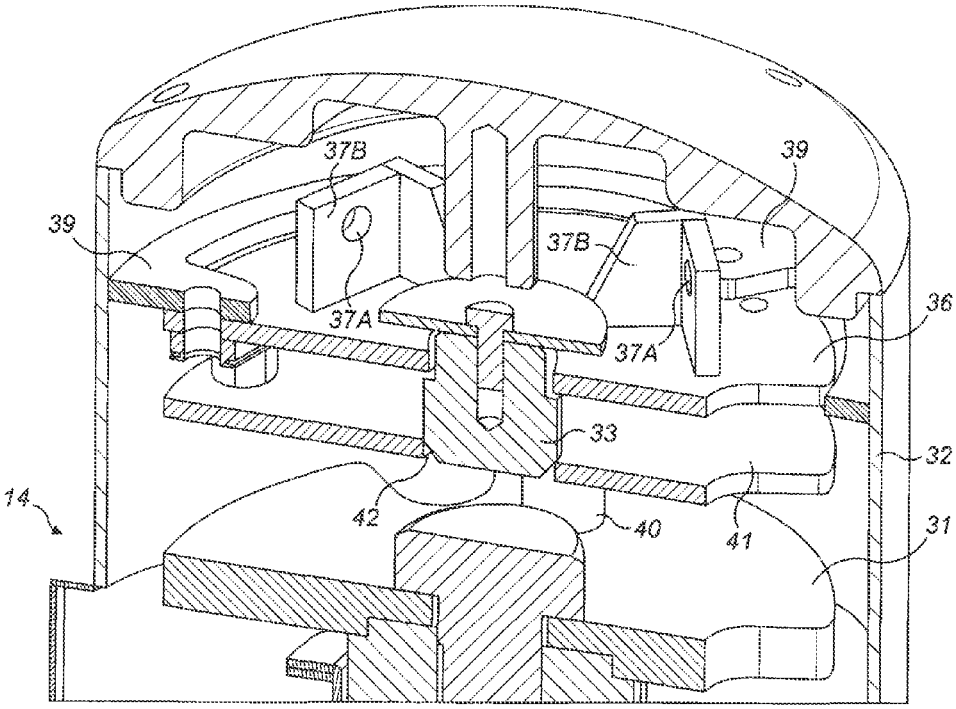
FIG. 7 is a magnified view of the head end of the stanchion shown in FIG. 6.
Figure 8:
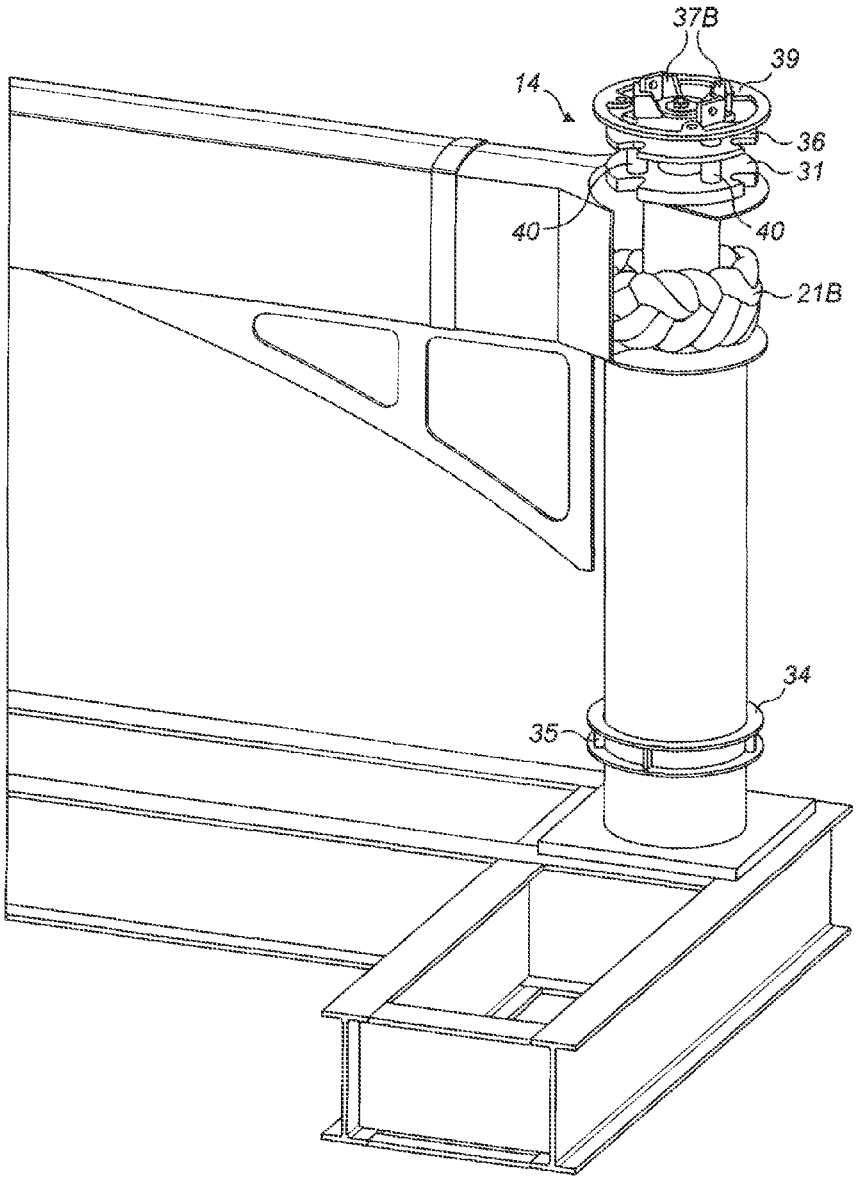
FIG. 8 is a view of internal parts of the stanchion of FIGS. 6 and 7.

FIGS. 6, 7 and 8 illustrate the structure of the first stanchion in more detail, either in a cross-sectional form or in a semi-transparent form (FIG. 8) to illustrate the internal components thereof. The first stanchion comprises a stop flange (31) located at the head end of the stanchion which projects outwardly (radially) over the proximal loop (21B) of the rope which passes around the shaft of the first stanchion.

A sleeve member (32, transparent in FIG. 8) is mounted over the shaft of the first stanchion and is arranged thereupon to revolve about the axis of the shaft of the first stanchion. The bridging arm is attached to the sleeve member such that a revolving movement of the sleeve member about the shaft of the first stanchion enables the bridging arm to move to and from a position of alignment in which the distal end of the bridging arm is in register with the head end of the second stanchion, as shown in FIG. 1.

The sleeve member comprises an elongate tube within which the shaft of the first stanchion is sheathed. The orientation of the sleeve member relative to the longitudinal axis of the shaft of the first stanchion is adjustable to adjust the inclination of the sleeve member relative to the access of the shaft of the first stanchion. This adjustability of inclination results in an adjustability of the inclination of the bridging arm to raise and lower the distal end (13) thereof thereby to adjust its alignment to the head end (5) of the second stanchion.

The sleeve member is mounted atop the shaft of the first sanction via a universal pivot (33) such that the sleeve member may be inclined in any direction relative to the axis of the first stanchion. Referring to FIG. 8, a bearing unit (34) is located towards the base end of the first stanchion and comprises an array of roller bearings (35) positioned at regular intervals circumferentially around the outer diameter of the shaft of the first stanchion. Alternatively, a sliding surface may be presented by the bearing unit. These roller bearings (or the sliding surface) are arranged to interface against the inner surface of the sleeve member which sheaths them, to assist the revolving movement of the sleeve member around the shaft of the first stanchion at the sleeve base. The bearing unit is dimensioned such that the bearings remain substantially in interface with the sleeve member at all times. Concurrently, inclination adjustment components (36,37,38) are mounted upon a horizontal plate (36) fixed to the universal pivot bearing connected to the top end of the sleeve member. These comprise a series of four bolts (38) which pass through threaded through-openings (37A) formed in upstanding flanges (37B) so as to extend generally transversely to the longitudinal access of the sleeve member and to engage, at their ends, individually and separately with adjacent inner surface parts of the sleeve member (32). Bolts are omitted from 14 FIGS. 6 to 8 for clarity, but shown in place in FIG. 11. Each one of the bolts is adjustable, by a turning or screwing action, to adjust the extent to which it extends from the threaded opening (37A) associated with it. In this way, the group of four bolts can be adjusted to extend by different respective amounts so as to collectively adjust the position of the head end of the sleeve member (32)*n* relative to the universal pivot joint (33) and the axis of the first stanchion concurrently. Once suitably adjusted, the horizontal plate upon which the upstanding flanges (37B) are fixed, may be fixed in place via bolts arranged to pass concurrently through dedicated bolt holes (40A,40B) formed in the horizontal plate and in flanges (39) extending radially inwardly from the bore of the sleeve member over the horizontal plate.

The bearing unit at the base of the first stanchion, being substantially always an interface with the base regions of the sleeve member, does not permit axial movement of the base portion of the sleeve. Consequently, any adjustment of the head end of the sleeve results in a change in the inclination of the sleeve member relative to the axis of the first stanchion, the inclination being effectively a pivoting movement about the coupling unit. In this way the inclination of the bridging arm may be adjusted by suitably adjusting one or more of the four adjustment bolts pivotably mounted at the head end of the first stanchion. The universal pivot comprises a circular aperture (42) formed in a disk member (41) mounted via mounting columns (40) atop the stop flange (31) of the first stanchion in register with the longitudinal axis of the stanchion. The tapered end of a cylindrical pivot block engages the periphery of the circular aperture slidingly and freely.

Figure 9:
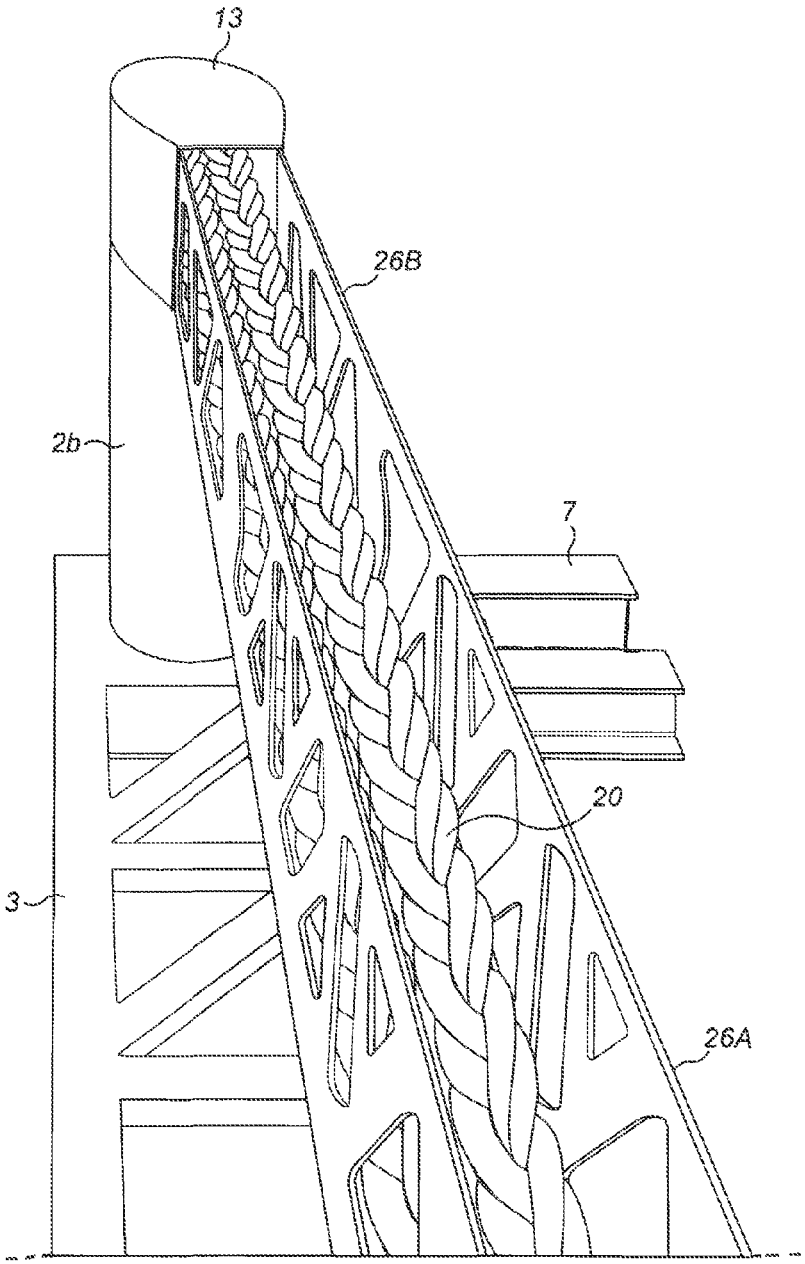
FIG. 9 shows a part view of an uncovered bridging arm extending from a first stanchion (not shown) to a second stanchion, supporting an un-tensioned plaid nylon rope which couples the two stanchions.

FIG. 9 shows a part view of an uncovered bridging arm extending from a first stanchion (not shown) to the second stanchion, supporting an un-tensioned nylon rope which couples the two stanchions.

Figure 10:
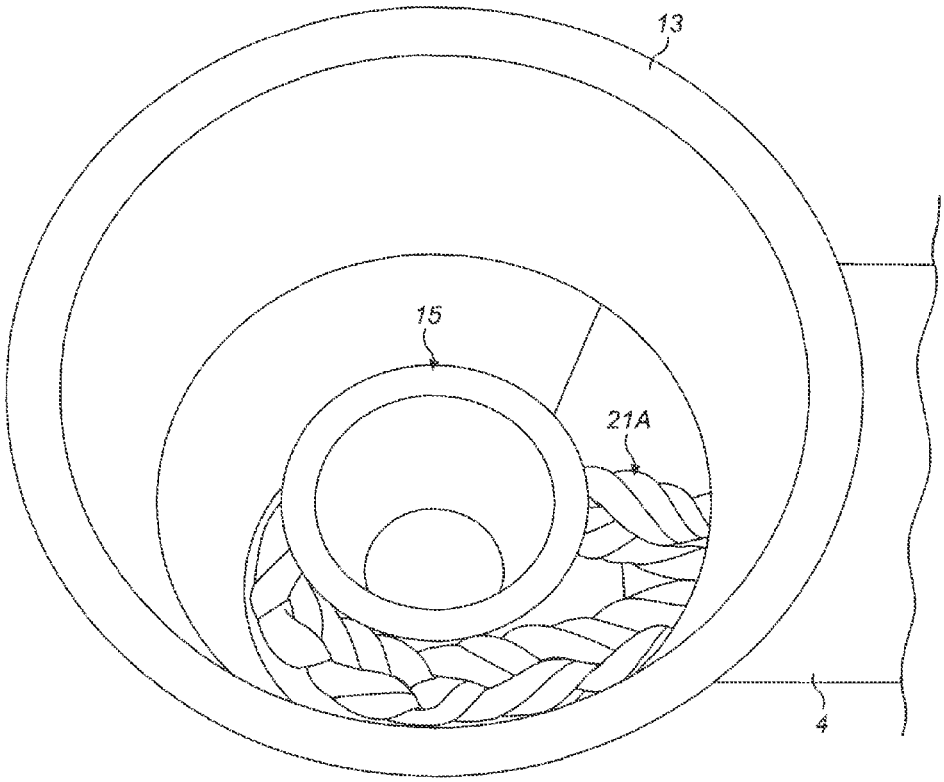
FIG. 10 shows a part view of the uncovered distal end of the bridging arm of FIG. 9 revealing the distal loop of the plaid nylon rope and the conduit passing though it adapted for receiving an obstruction shaft from the stanchion with which it is aligned.

FIG. 10 shows a part view of the uncovered distal end of the bridging arm of FIG. 9 revealing the distal loop of the plaid nylon rope and the conduit passing though it adapted for receiving an obstruction shaft from the second stanchion with which it is aligned.

Figure 11:
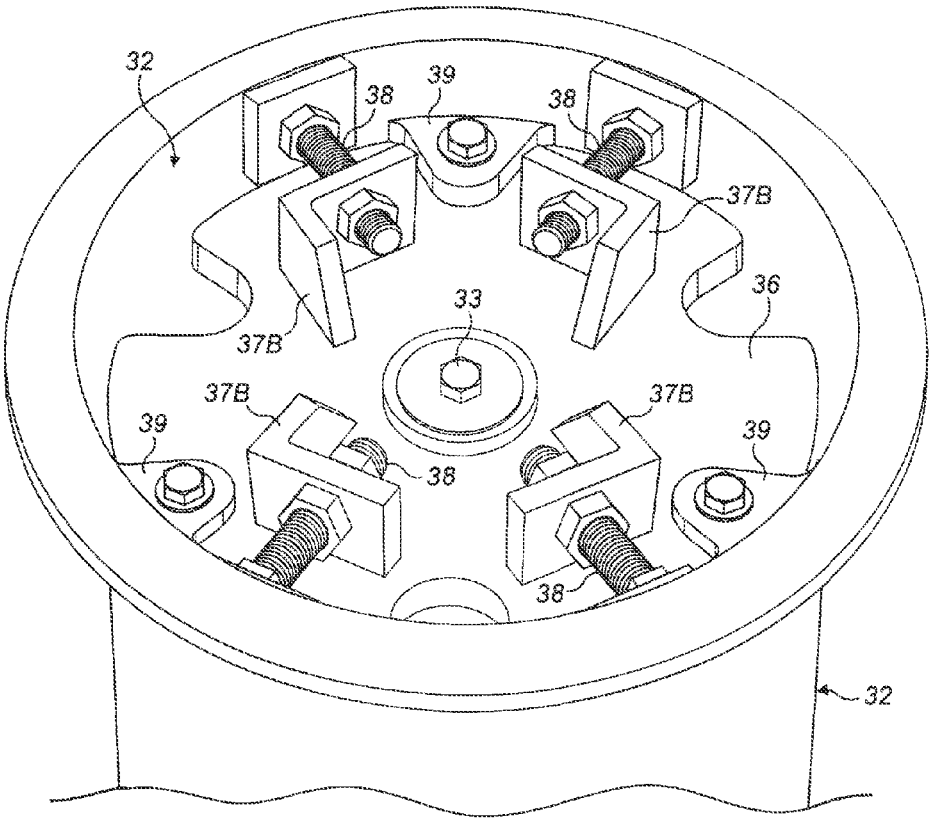
FIG. 11 shows a part view of the head end of the sleeve member which sheaths the shaft of the stanchion about which the bridging arm revolves, the array of four inclination adjustment bolts visible.

FIG. 11 shows a part view of the head end of the sleeve member which sheaths the shaft of the first stanchion about which the bridging arm revolves, the array of four inclination adjustment bolts is visible.

FIGS. 12 and 13 illustrate two alternative embodiments of the invention.

Referring to FIG. 12, there is shown a plan view of the gate comprising the first stanchion (2A) and rope (20) referred to above with reference to FIGS. 1 to 11, together with a modified form of bridging arm (52) and second stanchion (50). The second stanchion is modified such that the obstruction shaft (51) is fixed in position relative to the body of the second stanchion. The obstruction shaft extends transversely horizontally from the longitudinal axis of the second stanchion at a side of the second stanchion which faces the direction from which potentially impacting vehicles (indicated by thick arrow) are expected to approach. This also corresponds to the direction (shown by thin arrow) from which the distal end of the bridging arm approaches the second stanchion when the gate is being swung into the closed state.

The bridging arm is modified in that the conduit (15) at the distal end of the bridging arm is oriented horizontally so as to be able to receive the horizontal obstruction shaft when the distal end of the bridging are is brought into alignment therewith. The distal loop (21A) of the rope is wrapped around the conduit such that placement of the conduit over the obstruction shaft simultaneously loops the distal loop over the obstruction shaft. The distal loop is shown in cross section for clarity. The deformable collar member (18) at the end of the conduit is similarly placed over the obstruction shaft adjacent its waist portion.

FIG. 13 illustrates a further alternative embodiment in which the gate assembly is substantially as described above with reference to FIGS. 1 to 11 but in which the obstruction shaft (53) is fixed to the head end of the second stanchion (54) and extends substantially vertically therefrom. The bridging arm (4) is as described above, but is coupled by a pivot unit (100) rotatably to the first stanchion (2A) so as to be able to rise from and fall towards (shown by the thin arrow), a position in which the distal end of the bridging arm, and the distal loop within it, is in alignment with the fixed obstruction shaft, as shown in FIG. 13. The distal and proximal loops (21A, 21B) are shown in cross-sectional form for clarity.

FIG. 14 schematically illustrates how a group of (e.g. four) separate loop-ended ropes (20), substantially the same as the rope described with reference to FIGS. 1 to 13, may be used collectively within the bridging arm to removably loop onto the obstruction pin and the shaft of the first stanchion (2A) concurrently. The distal loops (21A) and proximal loops (21B) of each of the succession of ropes each loop around a common obstruction pin, or first stanchion shaft, respectively. This means that breakage or failure of one of the ropes will not result is failure of the entire group.

Preferably, in the examples described above, the rope supported by the bridging member is not tensioned within the bridging member. Its weight is supported by the bridging member. This ability to avoid tension in the quiescent rope enhances the longevity of the tensile, or impact-resistive properties of the rope. It avoids "creep" which often occurs in pre-tensioned barrier ropes. Such pre-tensioning is usually done to reduce the degree of shock-loading to which the rope would be subjected in the event of vehicular impact, because excessive shock-loading can damage a rope/line and reduce its performance. However, a pre-tension often falls over time ("creep") as a tensioned rope loses tension.

It has been found that nylon ropes, particularly plait ropes (e.g. "Nylon 12 Plaid" rope or "Plasma 12 Strand" rope or other ropes produced by Puget Sound Rope, of 1012 Second Street, Anacortes, Wash. 98221 USA), are suitable. They do not require pre-tensioning in preferred embodiments of the invention. Their % Elongation vs. Load characteristics make them suitable for absorbing and dispersing impact energies by stretching (not excessively) when subject to impact loads. The result is substantially the elimination of creep in preferred embodiments.

FIG. 15 illustrates an alternative implementation of the inventive concepts of the invention in the form of a fence or otherwise non-opening barrier. The barrier comprises an array of a plurality of stanchions (55,56 plus others) comprising at least a first stanchion (56) and a separate second stanchion (55). A flexible rope (20), such as the rope described in any embodiment above, is attached concurrently to the first stanchion via a first loop (21B) in a first end of the rope and to the second stanchion via a second loop (21A) in a second end of the rope. A bridging member (4) extends between each stanchion supporting the rope joining two neighbouring stanchions. The rope is not tensioned between the two stanchions. Its weight is supported by the bridging member. This ability to avoid tension in the quiescent rope enhances the longevity of the tensile, or impact-resistive properties of the rope. The structure and material of the bridging member (4) may be substantially as described above with respect to FIGS. 1 to 14 (e.g. frangible).

Each stanchion includes an obstruction shaft (110) fixed to the head end thereof to extend vertically upwardly. Each obstruction shaft is adapted to extend through a respective one of the first and second loops of the rope thereby each to obstruct removal of the loop from the associated obstruction shaft. This provides a barrier comprising the rope which extends between the first and second stanchions.

The each obstruction shaft presents a waist section adjacent to its head end, with a circumferential lip/flange at its head end, as described above with reference to FIGS. 1 to 14. An assembly comprising the conduit (15) topped by a deformable collar member (18) as described above with reference to FIGS. 1 to 14, is mounted over each of the obstruction shafts as described above, such that a given obstruction shaft passes along and extends out of the end of, the bore of the conduit mounted upon it. The loops of all of the ropes that loop over a given obstruction shaft are also looped around a common conduit.

There follows an analysis of a barrier according to an embodiment of the invention, and arranged to disrupt or contain a 7,500 kg vehicle travelling at 50 mph. The strength members comprise an aforesaid rope which will be considered to be contained in a volume 4 m in length, 323 mm in width and 300 mm in depth. The required stopping distance is specified to be 1.0-1.5 m.

It is intended that the design should be modular. Barriers of different strengths can be constructed by using a variable number of identical elements. The ropes are generally elliptical in cross section and have a length 4 m. They are terminated with loops in the form of eyelets which fit over obstruction shafts/pins on the stanchions/supports.

The rope has an elongation at breaking point of at least 25%. It is shown below that the combined spring constant of the rope is desirably greater than 3746 kN/m. in order to stop a 7,500 kg vehicle travelling at 50 mph in 1.5 m. The stopping time is 90 ms.

Two designs have been considered, one based on Plasma (identified above) rope spiraled on a rubber core and the other using 68 mm nylon rope (identified above). The spiral configuration is preferable with Plasma rope because the extension at breaking point is typically about 2%. Nylon rope has an extension at breaking point of about at least 30%.

The nylon rope design may be desirable because it does not require a core, it is easier to construct and does not depend on an accurately-determined lay length. The nylon rope design is described in more detail below.

The following is a calculation of a barrier spring constant. The following terms are defined:

v velocity of vehicle (m/s)
m mass of vehicle (kg)
E energy of vehicle (J)
F force acting in barrier (N)
L length of barrier (m)
y barrier penetration (m)
x extension of barrier (m)
k spring constant of barrier (N/m)

The kinetic energy of the vehicle is $$E = \frac{1}{2}mv^2$$

For m=7,500 kg and v=22.352 m/s (50 mph), the energy is $$E=1873 \text{ kJ}$$

The force F acting in the barrier is given by $$F=-kx$$

where x is the barrier extension. The equation of motion is given by $$\frac{d^2y}{dt^2} = -\frac{k}{m}f(y)$$

The form of the function $f(y)$ is given below. The extension x of the assembly by a pointed vehicle penetrating to a distance y is given by Pythagoras theorem $$(L+x)^2=L^2+4y^2$$

For L=4 m and y=1.5 m, the extension is $$x=1.0 \text{ m}$$

The energy stored in the spring is $$P = \frac{1}{2}kx^2$$

Equating this energy with the energy of the vehicle gives the spring constant $$k = \frac{2E}{x^2}$$

Substituting gives $$k=3746 \text{ kN/m}$$

A barrier assembly may comprise a nylon rope of diameter 68 mm and length 4 m. Extra 6 m lengths at both ends may be wrapped round to form eyelets and then spliced back down the rope. The cross section is elliptical with a minor diameter of 70 mm and a major diameter of 200 mm. The Puget Sound Rope gives an example if this having the following parameters for 68 mm rope:

Minimum tensile strength: 951.9 kN
Extension at breakpoint: 30-35%

The strength of a loop/eye-splice is about 1.7 times the tensile strength of the rope. Consequently the splice has a minimum strength of 1904 kN.

The spring constant of a length of rope is the force required to extend the rope by 1 m. For a 4 m length, 1 m corresponds to 25%. The force required to stretch the rope by 25% is 793 kN (using the value for 30% extension at break) and hence the spring constant is 793 kN/m. The back splicing means the assembly essentially consists of three ropes but the tensile strength will be less than for three separate ropes. Assuming the strength of three spliced ropes is 1.5 times the strength of single rope gives a spring constant of $$k=1190 \text{ kN/m}$$

Consequently the spring constants for 3 and 4 element assemblies are $$k=3570 \text{ kN/m 3 element}$$

$$k=4760 \text{ kN/m 4 element}$$

The spring constant required to stop a 7,500 kg vehicle travelling at 50 mph. in less 1.5 m needs to be greater than 3746 kN/m.

The following considers the forces acting on support posts/stanchions. The time dependence of the force acting in the barrier can be computed by numerical integration of the differential equation.

The equation of motion is $$m\frac{d^2y}{dt^2} = -2kx\sin\theta$$

where $$\sin\theta = \frac{y}{h}$$

The differential equation can be re-written as $$\frac{d^2y}{dt^2} = -\omega^2\left(4y - \frac{2Ly}{h}\right)$$

with $$\omega^2 = \frac{k}{m}$$

$$h = \frac{1}{2}\sqrt{L^2 + 4y^2}$$

$$x = 2h - L$$

The time step for the numerical integration was 0.0001 s. The following values were used:

$$L=4 \text{ m}$$

$$M=7.5\times10^3 \text{ kg}$$

$$K=3.746\times10^6 \text{ kN/m}$$

The initial conditions for the integration were $$y(0) = 0.0$$

$$\left(\frac{dy}{dt}\right)_{t=0} = 22.35\, m/s$$

The computed values of several parameters are shown in FIGS. 16A-16D.

Braided rope on a rubber core may be employed. One possible way to achieve the required spring constant is to use ropes spiraled or braided on a rubber core. Three assemblies would be used with spring constants of 1300 kN/m. A preliminary specification for the cylindrical module is:

Length: 4 m
Core diameter: 100 mm
Elongation at breaking point: 25%
Load at breaking point: 1300 kN
Number of turns of rope spiral: 18
Lay length: 0.2222 mm
Lay angle from longitudinal axis: 54.7 deg
Length of spiral: 6.927 m
Length of spiral at 25% core extension: 7.034 m
Max number of 10 mm rope spirals: 18

The length of a rope spiraled on a cylinder can be calculated in the following way. The rope can regarded as a line on a cardboard cylinder along which the cylinder is cut. The cardboard is then laid flat. The line forms the hypotenuse of a right-angled triangle. The variables are s arc length (length of rope)
L length of cylinder
C circumference of cylinder
n number of complete turns It follows that $$s^2=(nC)^2+L^2$$

If the cylinder is stretched by a factor $\alpha$, the dimensions of the triangle become, where $\sigma$ is the Poisson ratio of the cylinder:

$$(s') = n^2C^2(1-\sigma\alpha)^2 + L^2(1+\alpha)^2$$
$$\approx s^2 - 2\sigma\alpha n^2C^2 + 2\alpha L^2$$

In order that the rope elongates when the assembly is stretched, $$s'>s$$

This implies $$2\alpha L^2>2\sigma\alpha n^2C^2$$

Defining the lay length as $$L_0 = \frac{L}{n}$$

gives $$\frac{L_0}{C} > \sqrt{\sigma}$$

The lay angle $\theta$ from the longitudinal axis is given by $$\tan\theta = \frac{C}{L_0}$$

Hence $$\tan\theta<1/\sqrt{\sigma}$$

For rubber $\sigma$=0.5 and $$\theta<54.7\text{ deg}$$

Modifications variations and alterations to the exemplary embodiments described above, such as would be readily apparent to the skilled person, are encompassed within the scope of the invention, such as defined by the claims for example.

The invention claimed is:

1. A barrier apparatus comprising:
a first support and a separate second support;
a flexible coupler attached to the first support defining a through-opening;
a bridging member supporting said flexible coupler, wherein:
the bridging member is attached movably to the first support to be movable to and from a position which places said through-opening in alignment with the second support; and
the second support includes an obstruction part adapted to extend through said through-opening when said through-opening is placed in said alignment with the second support thereby to obstruct removal of said through-opening from said alignment with the second support to provide a barrier comprising said flexible coupler which extends between the first support and the second support, wherein the obstruction part is arranged to retractably extend through said through-opening from said second support.

2. A barrier apparatus according to claim 1 in which the obstruction part is adapted to removeably extend through the through-opening when the through-opening is placed in said alignment.

3. A barrier apparatus according to claim 1 in which the obstruction part is fixed to the second support and the bridging member is adapted to removeably place the through-opening around the obstruction part when the through-opening is placed in said alignment.

4. A barrier apparatus according to claim 1 in which the flexible coupler defines a further through-opening through which said first support extends.

5. A barrier apparatus according to claim 1 in which the flexible coupler comprises a flexible coupling line.

6. A barrier apparatus according to claim 1 in which the through-opening is a loop defined by the flexible coupler.

7. A barrier apparatus according to claim 1 in which the further through-opening is a loop defined by the flexible coupler.

8. A barrier apparatus according to claim 1 in which the flexible coupler comprises one or more of rope, cable, wire or chain.

9. A barrier apparatus according to claim 4 in which said through-opening and said further through-opening comprise separate loops joined by a splice within the flexible coupler.

10. A barrier apparatus according to claim 1 in which one or both of the first and second support comprises a stanchion.

11. A barrier apparatus according to claim 1 in which the obstruction part comprises a transverse flange projecting therefrom in a direction transverse to the direction in which the obstruction part is arranged to extend through the through-opening and positionable to locate said through-opening between the transverse flange and other parts of the second support.

12. A barrier apparatus according to claim 11 in which the bridging member includes a malleable conduit member extending through said through-opening and through which said obstruction part is adapted to removeably extend when said through-opening is in said alignment accordingly to locate the conduit member between the transverse flange and other parts of the second support.

13. A barrier apparatus according to claim 12 in which the malleable conduit member comprises a stop flange projecting outwardly of the conduit member in a direction transverse to the axis of the conduit and adapted to be movable to abut the transverse flange in response to motive force applied thereto by parts of the flexible coupler defining the through-opening.

14. A barrier apparatus according to claim 1 in which the first support comprises a further stop flange projecting outwardly therefrom over parts of the coupler defining the further through-opening thereby to obstruct movement of the through-opening therebeyond.

15. A barrier apparatus according to claim 1 in which the first support comprises a shaft part and a sleeve part mounted upon the shaft part to revolve about an axis thereof wherein which said bridging member is attached to the sleeve part to swing to and from said position of alignment by action of said revolving.

16. A barrier apparatus according to claim 15 in which the sleeve part is elongate and the shaft part defines an elongate axis sheathed by said sleeve part wherein the orientation of the sleeve part relative to the shaft part is adjustable to adjust the inclination thereof relative to the elongate axis of the shaft part thereby to adjust the inclination of the bridging member to raise or lower the through-opening to adjust said alignment.

17. A kit of parts for a barrier apparatus comprising:

a first support and a separate second support;

a flexible coupler adapted to attach to the first support defining a through-opening;

a bridging member adapted to support said flexible coupler, wherein:

the bridging member is arranged to attach movably to the first support to be movable to and from a position which places said through-opening in alignment with the second support; and the second support includes an obstruction part adapted to extend through said through-opening when said through-opening is placed in said alignment with the second support thereby to obstruct removal of said through-opening from said alignment with the second support to provide a barrier comprising said flexible coupler which extends between the first support and the second support, wherein the obstruction part is arranged to retractably extend through said through-opening from said second support.

* * * * *